United States Patent [19]

Holson

[11] 4,001,960

[45] Jan. 11, 1977

[54] PHOTO ALBUM COVER WITH FRAMED INSERT

[75] Inventor: Sheldon Holson, Norwalk, Conn.

[73] Assignee: The Holson Company (Conn. Corporation), Wilton, Conn.

[22] Filed: Mar. 16, 1976

[21] Appl. No.: 667,399

[52] U.S. Cl. ..... 40/159; 281/31

[51] Int. Cl.[2] ..... B42D 3/00

[58] Field of Search ..... 40/159, 158 R, 158 B, 40/10 R, 10 D, 124.2, 104.19, 152; 206/462, 486, 488, 489; 281/31

[56] References Cited

UNITED STATES PATENTS

| | | | |
|---|---|---|---|
| 478,390 | 7/1892 | Bergner | 281/31 |
| 2,111,382 | 3/1938 | Bennett | 206/44.11 |
| 2,801,115 | 7/1957 | Federbush et al. | 40/159 X |
| 2,850,294 | 9/1958 | Ortis et al. | 40/159 X |
| 2,852,275 | 9/1958 | Brook | 40/159 X |
| 3,214,853 | 11/1965 | Rolfs | 40/10 R |
| 3,587,848 | 1/1971 | Froehlig | 206/462 |
| 3,842,525 | 10/1974 | Deau | 40/159 |

*Primary Examiner*—John F. Pitrelli
*Attorney, Agent, or Firm*—Charles E. Temko

[57] ABSTRACT

A padded type photo album cover construction incorporating a metallic frame disposed within an opening therein for supporting a photographic print in exposed condition in substantially the plane of the exposed outer surface of the cover. The invention includes a novel method for manufacture of the product, whereby wastage of material is eliminated, together with a corresponding saving in labor. The construction may be incorporated into albums already existing.

3 Claims, 7 Drawing Figures

PHOTO ALBUM COVER WITH FRAMED INSERT

BRIEF DISCUSSION OF THE PRIOR ART

The manufacture of padded photo album covers including a relatively stiff base of cardboard and a laminated layer of synthetic resinous foam material, in turn covered by a layer of decorative vinyl material, is well known in the art. Although not inexpensive, it provides the appearance of a leather bound volume, and a soft feel or hand to the vinyl layer akin to that of genuine leather. Such albums have found wide acceptance among professional and amateur photographers. In such applications, however, unless the cover is hot stamped or otherwise labeled, the individual identification of such albums with respect to the subject matter of the contents is not an easy matter. In the absence of imprinting a name or title, a convenient way of providing identification is the exposure of a single photograph which suggests the nature of the contents. Attachment of such photograph to an outer surface of the album invites damage with the continued use of the album, thereby destroying the indicia and adversely affecting the appearance of the album. Such a procedure has not been widely attempted in the prior art.

SUMMARY OF THE INVENTION

Briefly stated, the invention contemplates the provision of a metallic picture frame resiliently embedded in a corresponding opening penetrating the plane of the front cover of a padded photographic album. The frame is formed to include peripheral beaded edges capable of engaging the edges of the cut opening in the cover to be retained thereby, and provide a rectangular recess for the reception of a photographic print beneath an opening in a front panel of the frame which is thereby positioned substantially in the plane of the cover. The portion of the cover which has been cut to form the opening is inserted into a correspondingly shaped recess in the frame to resiliently engage the inner peripheral surfaces thereof and support the photographic print against movement. Thus, material which would otherwise be wasted is utilized as a part of the frame. In cheaper constructions, the foam layer may be eliminated, and the beaded edges are of slightly smaller diameter to facilitate passage into position.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENTS

Figure 3:
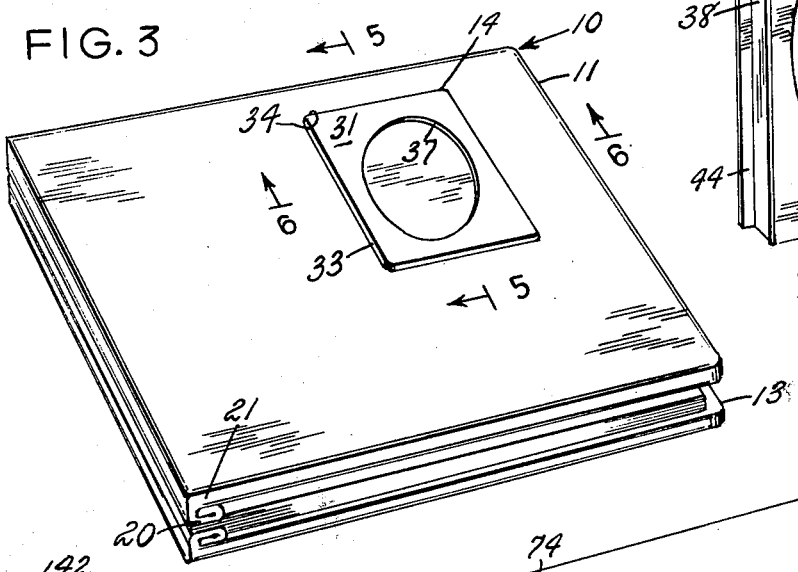
FIG. 3 is a view in perspective of a complete embodiment.

In accordance with the first embodiment of the invention, the device, generally indicated by reference character 10, is illustrated in FIG. 3 in the drawing in fully assembled condition. It includes an upper or front cover element 11, a filler of pages 12 and a lower or rear cover 13. The front cover element 11 is provided with an inserted frame element 14 capable of retaining for display a single photograph or other indicia (not shown).

The cover elements 11 and 13 are essentially similar, each including a main panel or wall 16, joined by a fold line 17 to an end wall 18. The wall 18 is joined by a fold line 19 to walls 20 and 21 which are interconnected by a fold line 22. The main panels 16 are of laminated construction (see FIGS. 5 and 6), each including a relatively rigid cardboard layer 25, a synthetic resinous foam layer 26, and an outer decorative lamina 27 of synthetic resinous material, such as vinyl. The inner surface of the cardboard layer 25 is preferably covered with a paper liner 28, as is well known in the art.

The frame element 14 is preferably formed as a single stamping from sheet metal, suitably plated or lacquered. It includes a forwardly disposed main wall 30 bounded by an outer surface 31 and an inner surface 32, as well as beaded edges 33, 34, 35 and 36. A centrally disposed opening 37 may be either ovoid, rectangular or other desired configuration. Extending rearwardly from the beaded edges 33–36 are a pair of side walls 38 and 39, and a pair of end walls 40 and 41. Fold lines 42 and 43 interconnect with side flanges 44 and 45 which are disposed at an angle of approximately 5° from a parallel relation with the plane of the wall 30, so as not to present a sharp edge on the inner surface of the front cover element when the device has been assembled.

Figure 1:
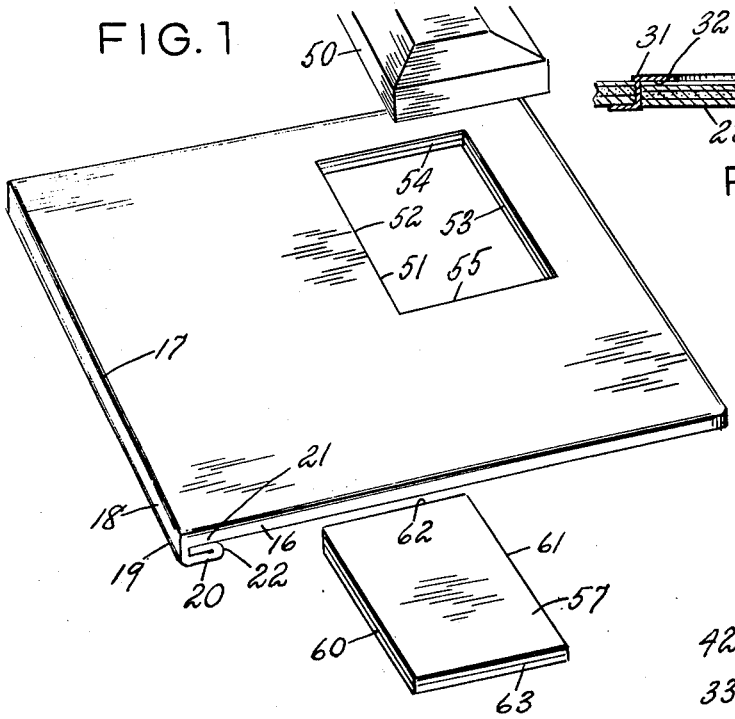
FIG. 1 is an exploded view in perspective showing a step in the manufacture of an embodiment of the invention.

Referring to FIG. 1, an opening for the frame element 14 is formed in the cover element 11 by a conventional rule die 50 which is pressed against the outer surface of the lamina 27 to form the opening 51, the side edges 52 and 53, and end edges 54 and 55 of which correspond to the walls 38–42, respectively, of the element 14. A cut out member 57 formed from the material previously disposed within the opening 51 is retained for insertion rearwardly into the frame element 14 to form a backing member. It is bounded by side edges 60 and 61, as well as end edges 62 and 63. As the metal comprising the frame element 14 is quite thin, and both the frame element and the cut out member 57 have a degree of resiliency, further fitting operations will not normally be required.

Figure 6:
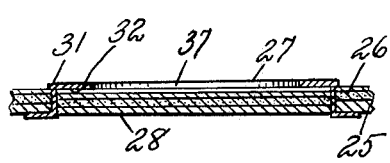
FIG. 6 is a fragmentary sectional view as seen from the plane 6—6 in FIG. 3.
Figure 5:
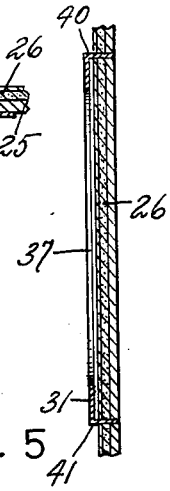
FIG. 5 is a fragmentary sectional view as seen from the plane 5—5 in FIG. 3.
Figure 2:
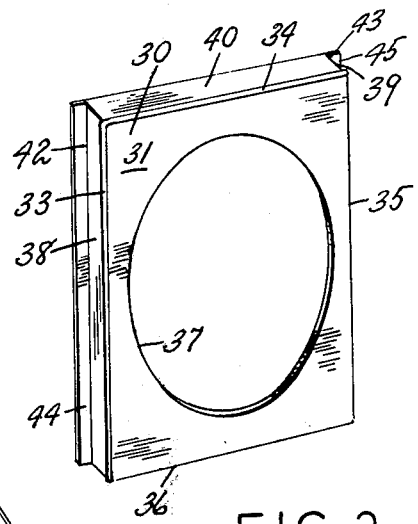
FIG. 2 is a view in perspective of a frame element forming part of the embodiment.

Referring to FIGS. 3, 5 and 6, the frame element 14 is pushed into the opening 51 from the inner surface of the element 11, and in fully seated condition, the beaded edges 33–36 will overlie the edges 52–55 to apply a slight compressive force upon the foam layer 26. The reaction to this force is formed by the pressure of the concealed surfaces of the flanges 44 and 45 against the inner surface of the element 11.

Figure 4:
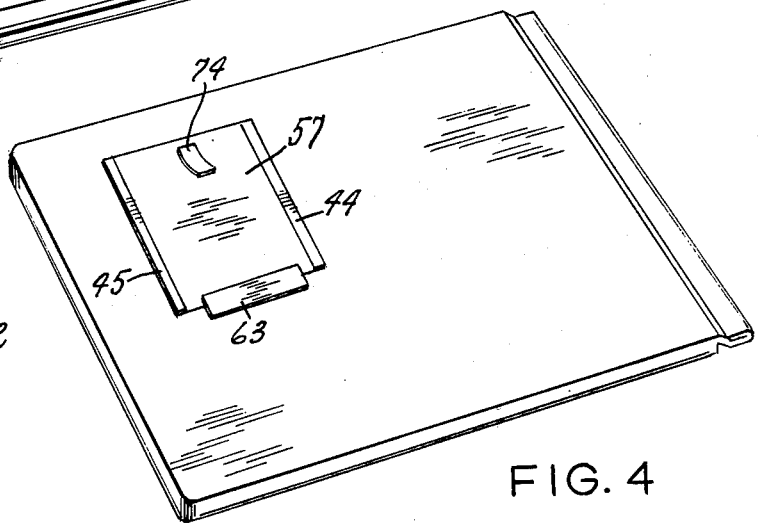
FIG. 4 is a view in perspective of a front cover of an album embodying the invention, showing an inner surface thereof.

As seen in FIG. 4, an optional hinge means 63 may be provided to retain the member 57 in position, and yet permit opening of the recess in the frame element to insert or replace a photographic print (not shown). Handle means formed from a strip of tape indicated by reference character 74 may also be provided.

Figure 7:
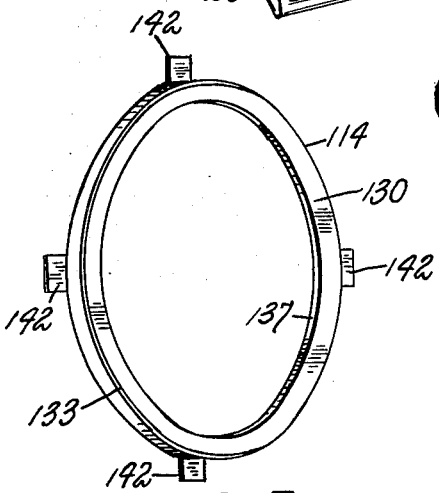
FIG. 7 is a view in perspective of an alternate form of the embodiment.

FIG. 7 illustrates an alternate shape of frame element 114 for use where an oval format is desired. To avoid needless repetition, parts corresponding to those of the principal form have been designated by similar reference characters with the additional prefix 1.

I wish it to be understood that I do not consider the invention limited to the precise details of structure shown and set forth in this specification, for obvious modifications will occur to those skilled in the art to which the invention pertains.

I claim:

1. In combination, a photo album cover and a frame element engaged therewith; said cover having a principal plane and comprising a plurality of laminated layers, said cover having a through opening extending perpendicular to the plane thereof of given size and configuration, and having outer and inner planar surfaces; said frame element including a generally planar outer wall having an opening therein, said wall being bordered by a beaded edge; side walls communicating with said beaded edge, and flange members carried by said side walls and lying in a plane substantially parallel to said outer wall, said side walls of said frame element corresponding in size and configuration to that of said opening in said cover; said frame element defining a recess between said side walls thereof, and a member maintained in said recess to underlie said opening in said outer wall thereof; said frame element being engaged within said opening such that said beaded edge overlies said outer surface of said cover in the area bordering said opening, and said flange members engage said inner surface of said cover, whereby said frame element is positively retained in said through opening.

2. Structure in accordance with claim 1, wherein said member is resiliently maintained in said recess to underlie said opening in said outer wall thereof.

3. The method of manufacturing a photographic album cover to include an enclosed frame element extending through an opening therein, comprising the steps of:

providing a cover element having a principal plane and a plurality of laminated layers;

cutting a shaped opening of predetermined size and configuration extending through said principal plane to form a cut out member from the material disposed within said opening;

providing a frame element of overall configuration corresponding to said opening, said frame element including a planar front wall having an opening therein, and bordered by a beaded edge, said frame element having a plurality of side members extending laterally from the plane of said front wall, and a plurality of flanges extending from said side walls in spaced substantially parallel relation to the plane of said front wall, said frame element defining a recess between said side walls;

inserting said frame element into said shaped opening in said cover element to engage said beaded edge thereof with an outer surface of said cover element in an area bordering said opening, and abut said flanges with an oppositely disposed surface of said cover element in areas bordering said opening; and positioning said cut out member in said recess in said frame element to underlie said opening in said front wall thereof.

* * * * *